US010345755B2

(12) United States Patent
Ando

(10) Patent No.: US 10,345,755 B2
(45) Date of Patent: Jul. 9, 2019

(54) COVER LOCKING DEVICE AND IMAGE FORMING APPARATUS

(71) Applicant: KYOCERA Document Solutions Inc., Osaka (JP)

(72) Inventor: Satoshi Ando, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 8 days.

(21) Appl. No.: 15/790,304

(22) Filed: Oct. 23, 2017

(65) Prior Publication Data

US 2018/0113414 A1 Apr. 26, 2018

(30) Foreign Application Priority Data

Oct. 24, 2016 (JP) ..... 2016-207503

(51) Int. Cl.

| | |
|---|---|
| ***G03G 21/16*** | (2006.01) |
| ***G03G 15/08*** | (2006.01) |
| *G03G 15/00* | (2006.01) |
| *E05B 65/00* | (2006.01) |

(52) U.S. Cl.

CPC ..... *G03G 21/1633* (2013.01); *G03G 15/0855* (2013.01); *E05B 65/006* (2013.01); *G03G 15/502* (2013.01); *G03G 15/556* (2013.01); *G03G 2221/169* (2013.01); *G03G 2221/1654* (2013.01)

(58) Field of Classification Search

CPC ..... G03G 21/185; G03G 21/1623; G03G 21/1633; G03G 21/1647; G03G 21/1842; G03G 2221/169; G03G 2221/1654

See application file for complete search history.

(56) References Cited

U.S. PATENT DOCUMENTS

| | | | | |
|---|---|---|---|---|
| 2010/0272452 | A1 | 10/2010 | Tsukijima | |
| 2017/0315499 | A1* | 11/2017 | Maeda | G03G 21/1676 |
| 2017/0315503 | A1* | 11/2017 | Maeda | G03G 15/0872 |
| 2018/0052419 | A1* | 2/2018 | Maeda | G03G 15/6502 |

* cited by examiner

*Primary Examiner* — Thomas S Giampaolo, II
(74) *Attorney, Agent, or Firm* — Wenderoth, Lind & Ponack, L.L.P.

(57) ABSTRACT

An image forming apparatus includes a restriction member that is rotatable between a first position, in which opening of a locking cover is restrictable in engagement with the locking cover, and a second position in which engagement with the locking cover is disengaged, a coil spring that urges the restriction member to the first position, a solenoid that is driven according to electric conduction to move the restriction member to the second position, a link member that transmits driving force generated in the solenoid to the restriction member, and a restraint part that restrains movement of the link member in a direction crossing a driving direction.

7 Claims, 8 Drawing Sheets

COVER LOCKING DEVICE AND IMAGE FORMING APPARATUS

CROSS-REFERENCE TO RELATED APPLICATION

This application is based upon and claims the benefit of priority from Japanese Patent Application No. 2016-207503 filed on Oct. 24, 2016, the entire contents of which are incorporated herein by reference.

BACKGROUND

The technology of the present disclosure relates to an image forming apparatus that forms an image by using a developer, and a cover locking device provided to the image forming apparatus.

In an electrophotographic image forming apparatus, an image forming process is performed to form an image on a sheet by using a developer such as toner. This type of image forming apparatus includes a developer accommodating unit which is detachable from its own apparatus and accommodates a developer.

Furthermore, in this type of image forming apparatus, detachment of the developer accommodating unit mounted at its own apparatus may be restricted. For example, there has been proposed an image forming apparatus in which a cover member opened and closed at the time of attachment/detachment of the developer accommodating unit is locked, so that the developer accommodating unit can be restricted from being detached by a user.

Specifically, the image forming apparatus employing the aforementioned related art includes a restriction member, an urging member, and a solenoid. The restriction member is rotatable between a first position, in which opening of the cover member is restricted in engagement with the cover member in a closed state, and a second position in which engagement with the cover member is disengaged. The urging member urges the restriction member to the first position. The solenoid is driven according to electric conduction to move the restriction member to the second position.

SUMMARY

A cover locking device according to one aspect of the present disclosure includes a cover member, a restriction member, an urging member, a solenoid, a link member, and a restraint part. The cover member opens and closes an opening provided at a side of an image forming apparatus. The restriction member is rotatable between a first position, in which opening of the cover member is restrictable in engagement with the cover member in a closed state, and a second position in which engagement with the cover member is disengaged, the second position being located inside the cover member from the first position. The urging member urges the restriction member to the first position. The solenoid is provided inside the cover member from the restriction member and is driven according to electric conduction to move the restriction member to the second position. The link member is provided in a long shape along a driving direction of the solenoid, includes a rotating shaft of the restriction member, is connected to the restriction member in a position different from a position crossing a reference surface perpendicular to the driving direction, and transmits driving force generated in the solenoid to the restriction member. The restraint part restrains movement of the link member in a direction crossing the driving direction in contact with the link member.

An image forming apparatus according to another aspect of the present disclosure includes the cover locking device, a developer accommodating unit, and an image forming unit. The developer accommodating unit is detachably provided to the opening and accommodates developers. The image forming unit forms an image by using the developers supplied from the developer accommodating unit.

DETAILED DESCRIPTION

Figure 1:
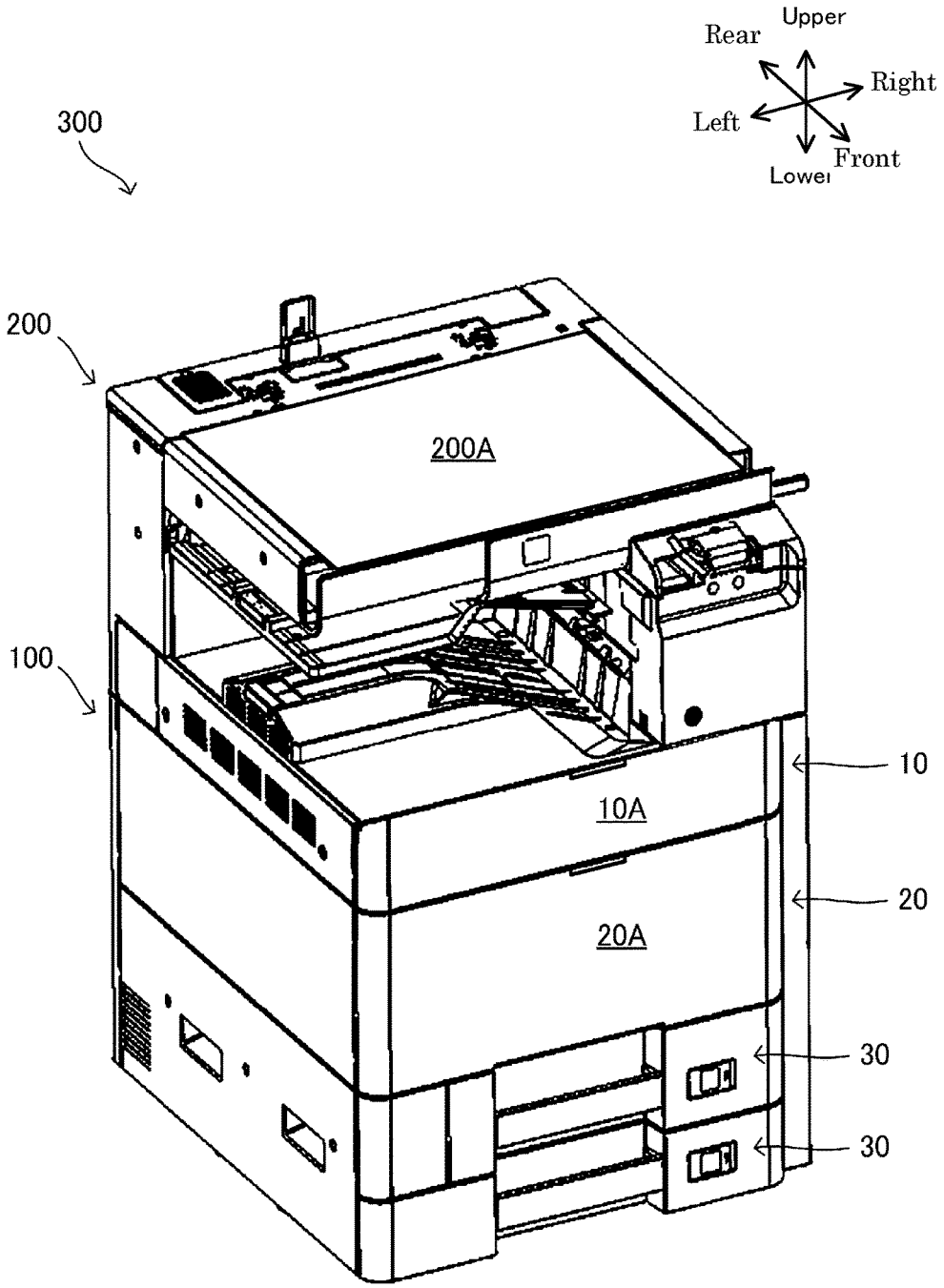
FIG. 1 is a diagram illustrating a configuration of a multifunctional peripheral according to an embodiment.

Hereinafter, an embodiment of the technology of the present disclosure will be described with reference to the accompanying drawings. The following embodiment is an embodied example of the technology of the present disclosure and is not intended to limit the technical scope of the present disclosure. In addition, the embodiment will be described using a front and rear direction and an upper and down direction defined in the drawings.

As illustrated in FIG. 1, a multifunctional peripheral 300 (an example of an image forming apparatus) according to an embodiment includes an image forming device 100 and an image reading device 200. The image reading device 200 is mounted on the image forming device 100. The image reading device 200 can read image data from a document placed on a document table 200A by using an imaging element such as a CCD. The image forming apparatus may be a printer at which the image reading device 200 is not mounted.

The image forming device 100 is a color printer including a container accommodating unit 10, an image forming unit 20, sheet feeding cassettes 30 and the like. To the container accommodating unit 10, a plurality of developer accommodating units 101 (see FIG. 4) accommodating developers such as a plurality of colors of toner are individually detachable.

The container accommodating unit 10 is provided at a front surface thereof with a front cover 10A that is openable and closable. Furthermore, the image forming unit 20 is provided at a front surface thereof with a front cover 20A that is openable and closable. In addition, the image forming device 100 is provided with an opening and closing detection unit 10B (see FIG. 2) such as an optical sensor in order to detect the opening and closing of the front cover 10A.

Each of the front cover 10A and the front cover 20A, for example, is supported such that its lower end portion is rotatable by a rotating shaft parallel to the right and left direction. That is, each of the front cover 10A and the front cover 20A is opened when its upper part is rotated forward. Each of the sheet feeding cassettes 30 is detachable from the image forming device 100 and stores sheets such as papers on which an image is formed.

Figure 2:
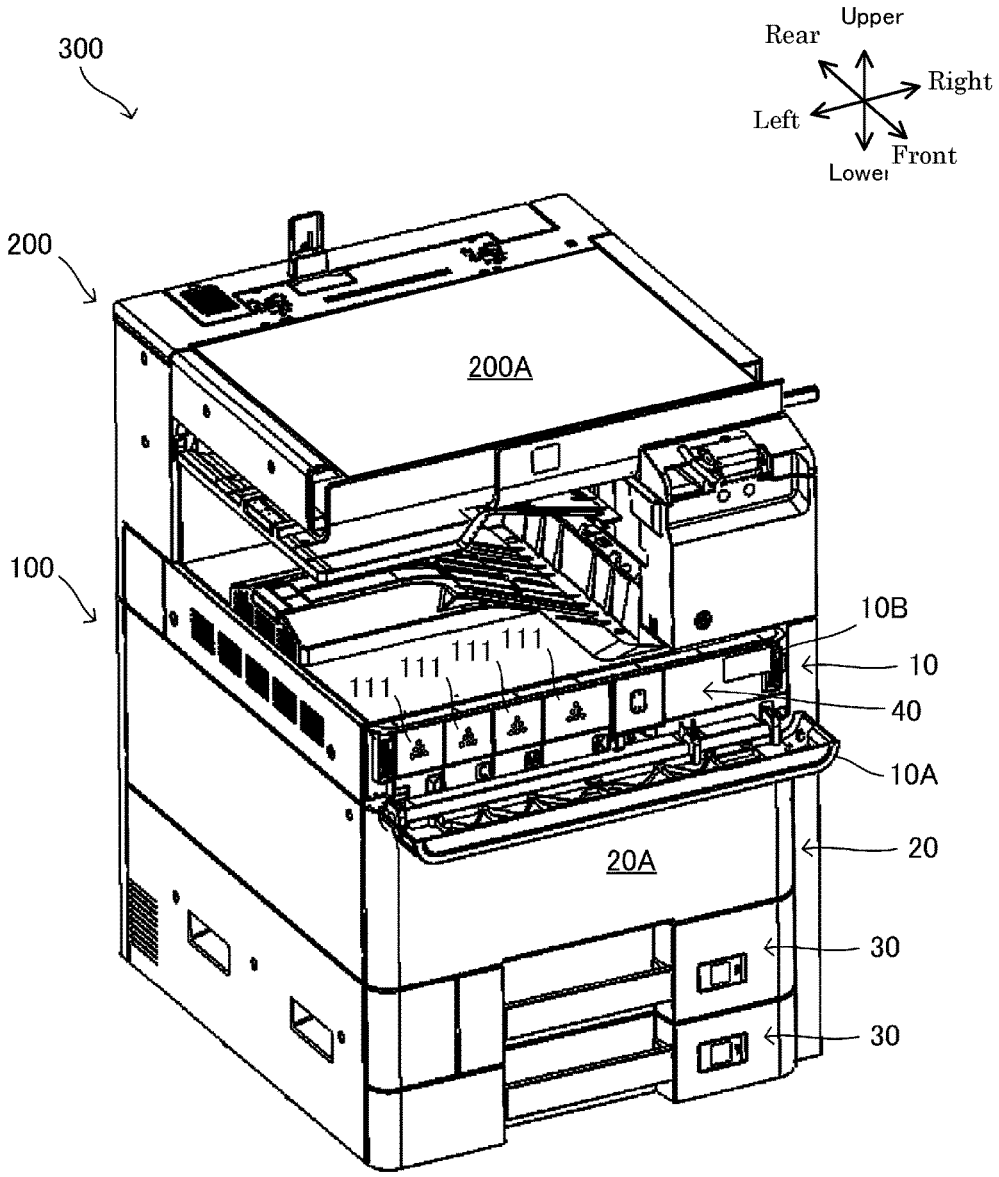
FIG. 2 is a diagram illustrating a configuration of a multifunctional peripheral according to an embodiment.

FIG. 2 illustrates the multifunctional peripheral 300 in a state in which the front cover 10A has been opened. The container accommodating unit 10 is provided with a locking unit 40 for switching attachment/detachment of the plurality of developer accommodating units 101 accommodating developers such as toner.

The locking unit 40 is an optional unit detachable from the container accommodating unit 10 of the image forming device 100. The locking unit 40 includes a plurality of cover locking devices 11 (see FIG. 5) corresponding to the plurality of developer accommodating units 101. In the cover locking devices 11, locking covers 111 (an example of a cover member) corresponding to the developer accommodating units 101 accommodating developers of each color are individually openable and closable.

Figure 3:
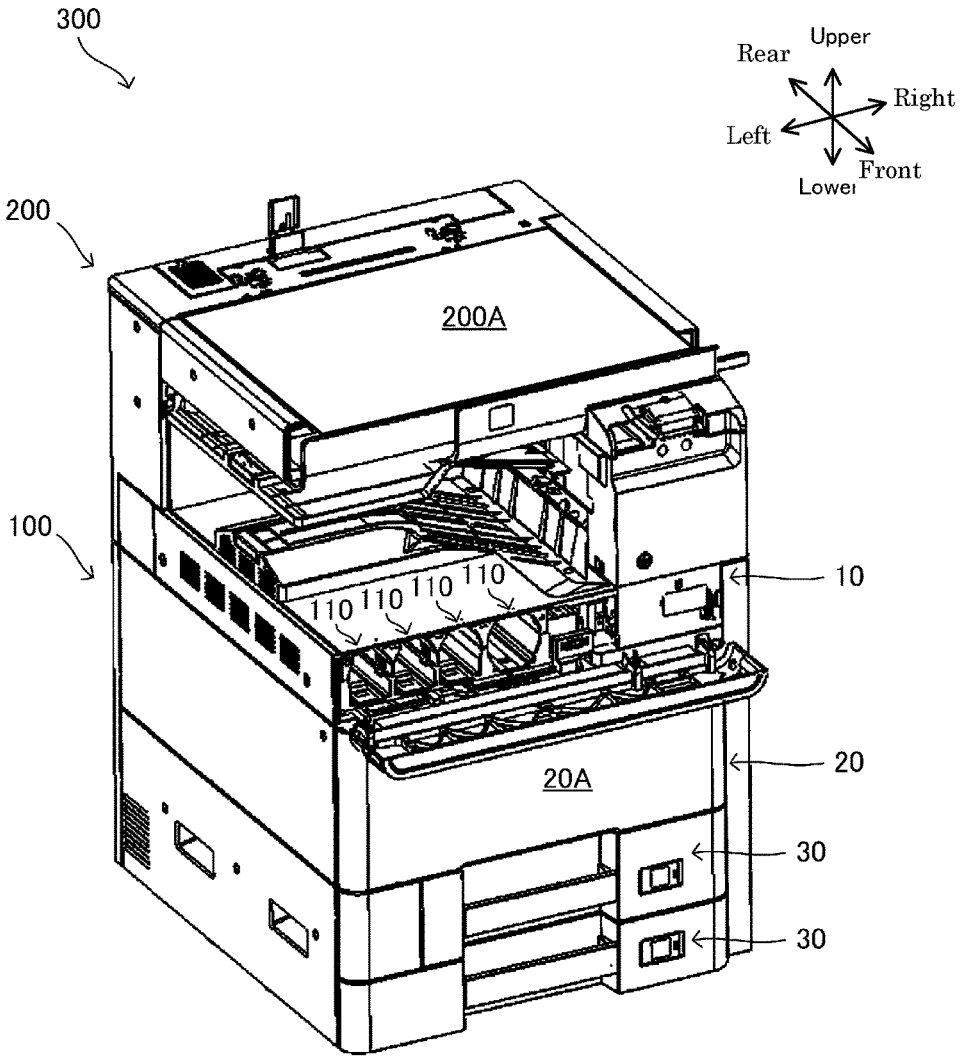
FIG. 3 is a diagram illustrating a configuration of a multifunctional peripheral according to an embodiment.

FIG. 3 illustrates the multifunctional peripheral 300 in a state in which the locking covers 111 have been detached. In the front surface of the multifunctional peripheral 300, each of the locking covers 111 is provided at an inside thereof with an opening 110 that is opened and closed by the locking cover 111. The developer accommodating unit 101 is detachable from the opening 110. The locking cover 111 is opened and closed at the time of attachment/detachment of the developer accommodating unit 101.

Furthermore, the cover locking device 11 can switch the presence or absence of restriction of opening (the presence or absence of locking) of the locking cover 111. Details of the locking unit 40 will be described later. In the image forming device 100, even in a state in which the locking unit 40 is not mounted, since the attachment/detachment of the developer accommodating unit 101 is possible, the image forming device 100 is available in the state in which the locking unit 40 is not mounted.

Figure 4:
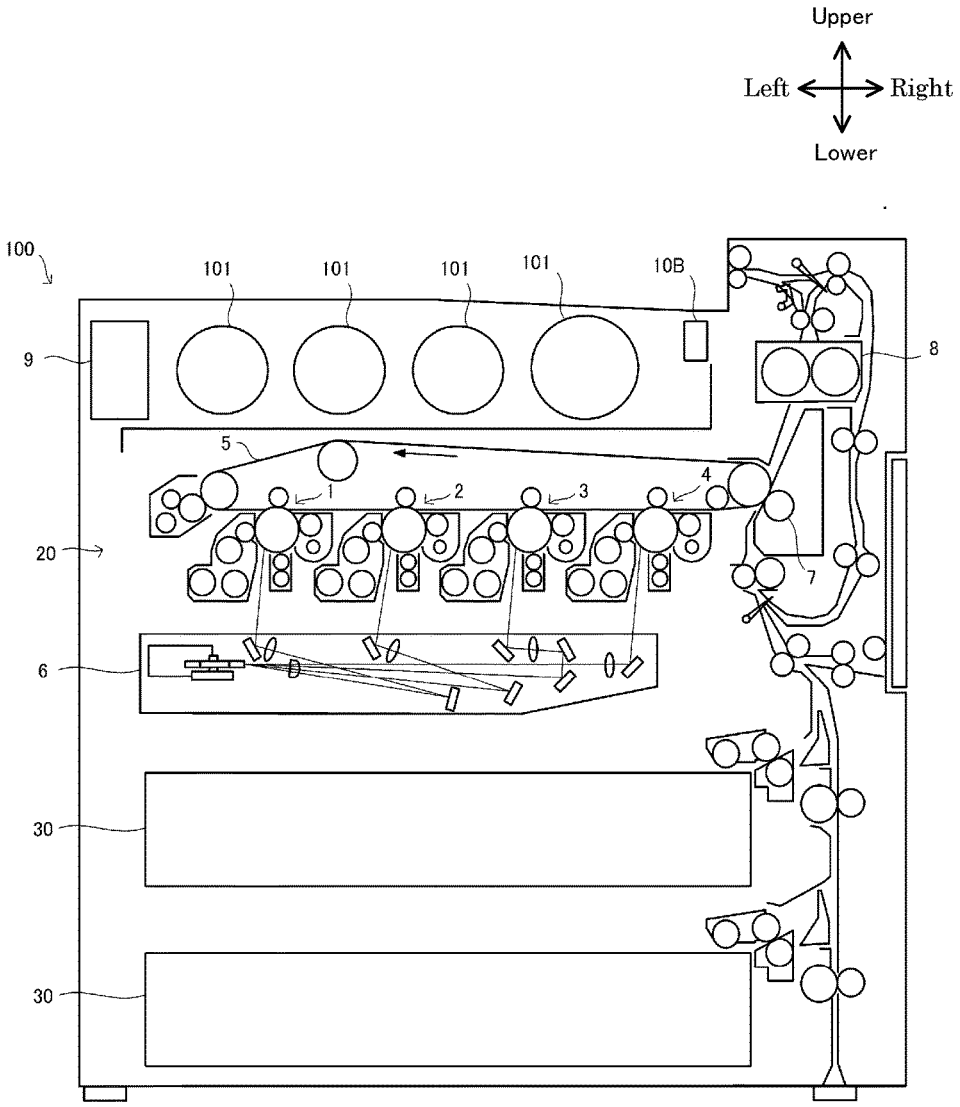
FIG. 4 is a diagram illustrating a configuration of an image forming apparatus of a multifunctional peripheral according to an embodiment.

As illustrated in FIG. 4, the image forming unit 20 includes a plurality of image forming units 1 to 4, an intermediate transfer belt 5, an optical scanning device 6, a secondary transfer device 7, a fixing device 8 and the like. The image forming unit 20 can form a monochromatic image or a color image on the sheet such as the paper supplied from the sheet feeding cassette 30 by using the developers accommodated in the developer accommodating units 101.

Each of the image forming units 1 to 4 is an electrophotographic image forming unit that forms an image by using the developers accommodated in the developer accommodating units 101. Each of the image forming units 1 to includes a photosensitive drum, a charging device, a developing device, a primary transfer device, a drum cleaning device and the like. The image forming units 1 to 4 are provided in parallel along a traveling direction of the intermediate transfer belt 5 to constitute the so-called tandem type image forming unit 20. To the developing device of each of the image forming units 1 to 4, the developers of each YMCK color are supplied from each of the developer accommodating units 101.

Furthermore, the image forming device 100 is provided with a control unit 9 which includes a CPU, a ROM, a RAM and the like to control the image forming device 100 and the image reading device 200. Specifically, the control unit 9 detects a remaining amount or a used amount of the developer accommodated in each of the developer accommodating units 101, and informs a display unit and the like (not illustrated) of an error of reduction of a remaining developer amount when the remaining amount or the used amount of the developer reaches a threshold value decided in advance. For example, the remaining amount or the used amount of the developer can be detected on the basis of a detection result by an optical sensor, a weight sensor and the like, or a calculation result based on the number of printed sheets, a printing rate and the like.

Furthermore, as described above, the control unit 9 performs the locking control process for arbitrarily switching the opening or closing of each of the locking covers 111 in the cover locking devices 11 to be described later. Specifically, in the locking control process, when the remaining amount of the developer accommodated in each of the developer accommodating units 101 is detected, the control unit 9 locks a locking cover 111 corresponding to a developer accommodating unit 101 in which the remaining amount of the developer exceeds the threshold value, and unlocks a locking cover 111 corresponding to a developer accommodating unit 101 in which the remaining amount of the developer is equal to or less than the threshold value.

More specifically, in a state in which the remaining amount of the developer of a certain developer accommodating unit 101 is equal to or less than the threshold value, when the opening of the front cover 10A is detected by the opening and closing detection unit 10B, the control unit 9 unlocks a locking cover 111 corresponding to the developer accommodating unit 101. In this case, the locking cover 111, which is unlocked among the plurality of locking covers 111, is only a locking cover 111 corresponding to a developer accommodating unit 101 in which the remaining amount of the developer is equal to or less than the threshold value.

In this way, when a user opens the front cover 10A, the locking cover 111, which corresponds to the developer accommodating unit 101 required to be exchanged among the plurality of locking covers 111, is unlocked. Accordingly, a developer accommodating unit 101, which is not required to be exchanged because the remaining amount of the developer exceeds the threshold value, is prevented from being wastefully exchanged. In addition, unlocking conditions of the locking covers 111 are not limited thereto.

Subsequently, with reference to FIG. 5 to FIG. 7, the locking unit 40 will be described. FIG. 7 is a diagram illustrating a state in which locking of the locking covers 111 by the cover locking device 11 has been released.

Figure 5:
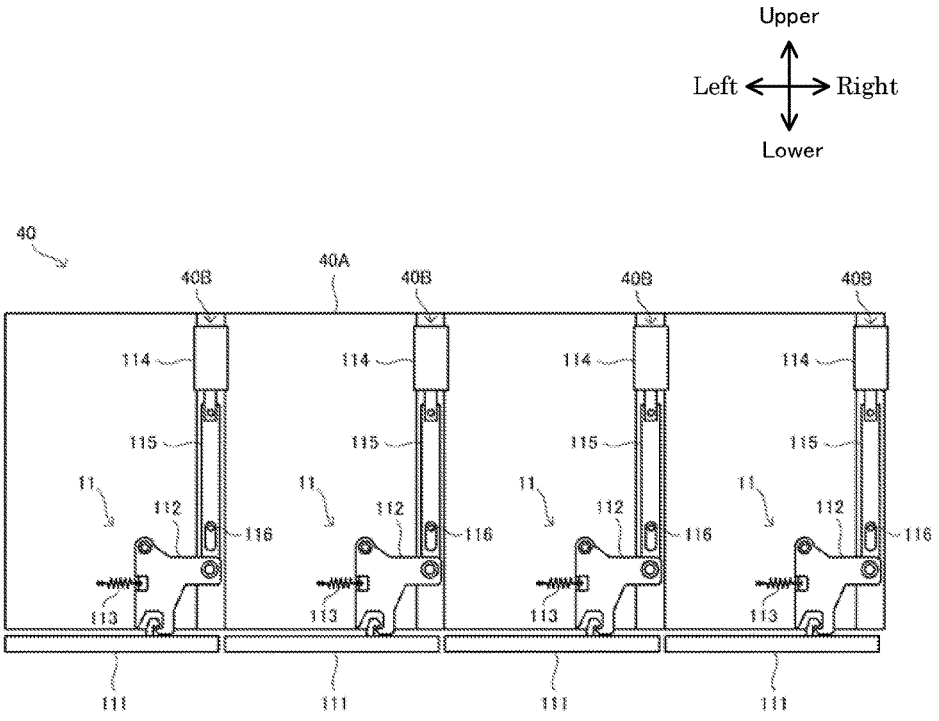
FIG. 5 is a diagram illustrating a configuration of a locking unit of a multifunctional peripheral according to an embodiment.

As illustrated in FIG. 5, the locking unit 40 includes a frame member 40A and four cover locking devices 11. The frame member 40A is a member that forms an upper part of each of the openings 110. On the upper surface of the frame member 40A, concave parts 40B formed along the front and rear direction are provided in correspondence with the cover locking devices 11.

As illustrated in FIG. 5, each of the cover locking devices 11 includes the locking cover 111, a restriction member 112, a coil spring 113 (an example of an urging member), a solenoid 114, a link member 115, and a restraint part 116. The restriction member 112, the coil spring 113, and the solenoid 114 of each of the cover locking devices 11 are provided on the upper surface of the frame member 40A. Furthermore, the link member 115 and the restraint part 116 of each of the cover locking devices 11 are provided in the concave part 40B of the frame member 40A.

The locking cover 111 is supported such that its lower end portion is rotatable by the rotating shaft which is provided to a frame member (not illustrated) forming a lower part of each of the openings 110 and is parallel to the right and left direction. That is, similarly to the front cover 10A of the container accommodating unit 10, the locking cover 111 is opened when its upper part is rotated forward.

The locking cover 111 is provided at an upper portion thereof with an engaged part 111A engageable with the restriction member 112. The engaged part 111A is formed in a hook shape that protrudes from the rear surface of the locking cover 111 and is bent in the right direction as illustrated in FIG. 6.

The restriction member 112 has an engaging part 112A engageable with the engaged part 111A of the locking cover 111. The engaging part 112A is formed in a hook shape that protrudes forward and is bent in the left direction as illustrated in FIG. 6.

Furthermore, the restriction member 112 is provided on the upper surface of the frame member 40A so as to be rotatable. Specifically, the frame member 40A is provided on the upper surface thereof with a rotating shaft 40C as illustrated in FIG. 6. On the other hand, the restriction member 112 has a shaft hole 112B into which the rotating shaft 40C can be inserted. The shaft hole 112B is inserted around the rotating shaft 40C, so that the restriction member 112 is supported to the frame member 40A so as to be rotatable in a rotation direction D1.

The restriction member 112 can be rotated between a first position P1 (see FIG. 6) in which the opening of the locking cover 111 can be restricted and a second position P2 (see FIG. 6 and FIG. 7) in which restriction (locking) of the opening of the locking cover 111 is released. The first position P1 is a position in which the engaging part 112A is engageable with the engaged part 111A of the locking cover 111 in a closed state as illustrated in FIG. 6. Furthermore, the second position P2 is located inside the locking cover 111 from the first position P1 and is a position in which the engagement of the engaging part 112A and the engaged part 111A of the locking cover 111 is disengaged as illustrated in FIG. 6 and FIG. 7. In addition, rotation of the restriction member 112 to the left from the first position P1 and rotation of the restriction member 112 to the right from the second position P2 are restricted by a locking part (not illustrated) provided on the upper surface of the frame member 40A.

The coil spring 113 urges the restriction member 112 to the first position P1. Specifically, as illustrated in FIG. 6, the coil spring 113 is provided on the upper surface of the frame member 40A to extend in the right and left direction. The coil spring 113 has one end in the longitudinal direction, which is fixed to a first fixing part 112D provided at the left side of the restriction member 112, and the other end which is fixed to a second fixing part 40D provided on the upper surface of the frame member 40A. The coil spring 113 is fixed to the first fixing part 112D and the second fixing part 40D in a more extended state than a natural length. Therefore, the restriction member 112 is pulled leftward by the coil spring 113 and is urged to the first position P1.

Figure 6:
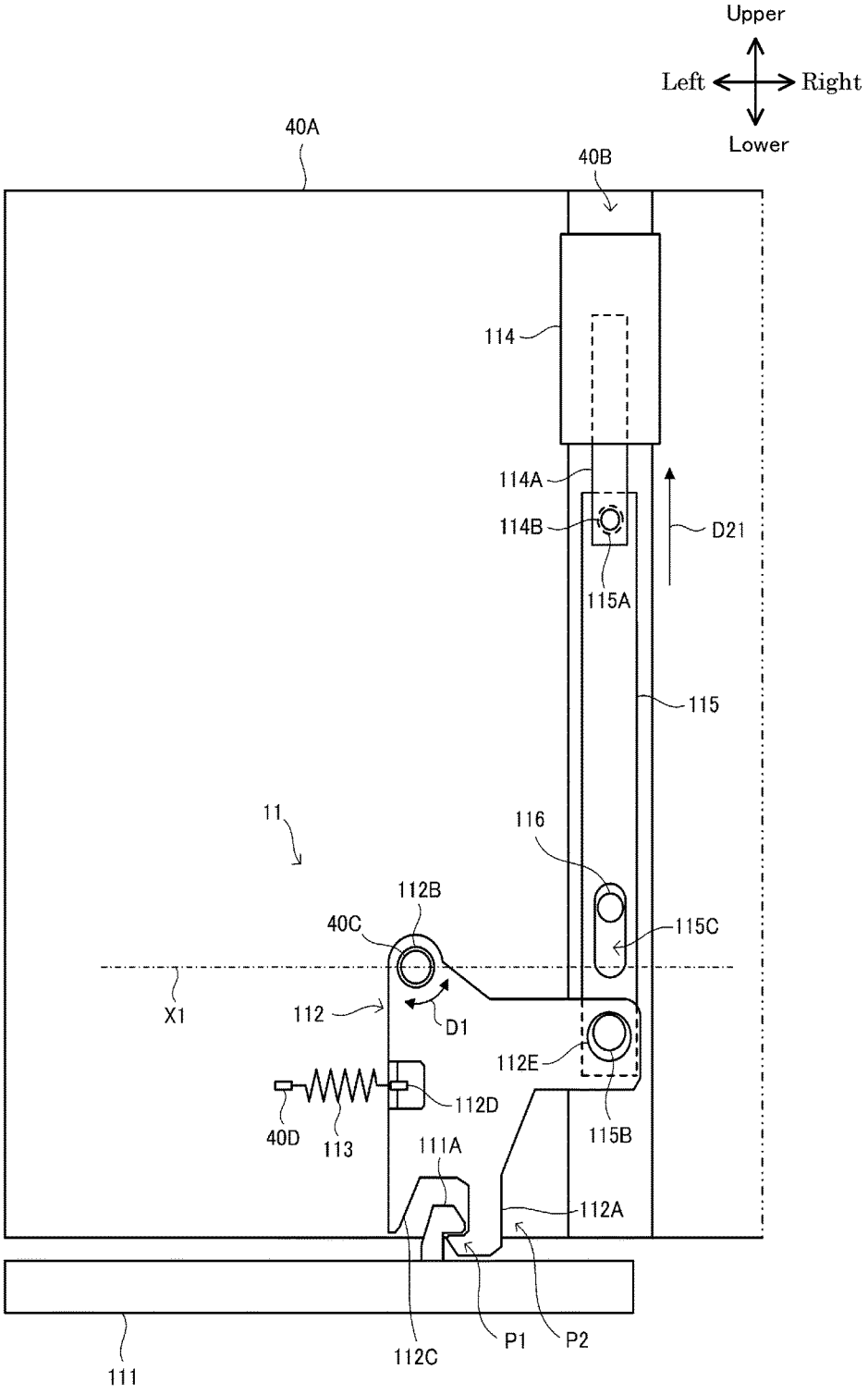
FIG. 6 is a diagram illustrating a configuration of a cover locking device of a multifunctional peripheral according to an embodiment.
Figure 7:
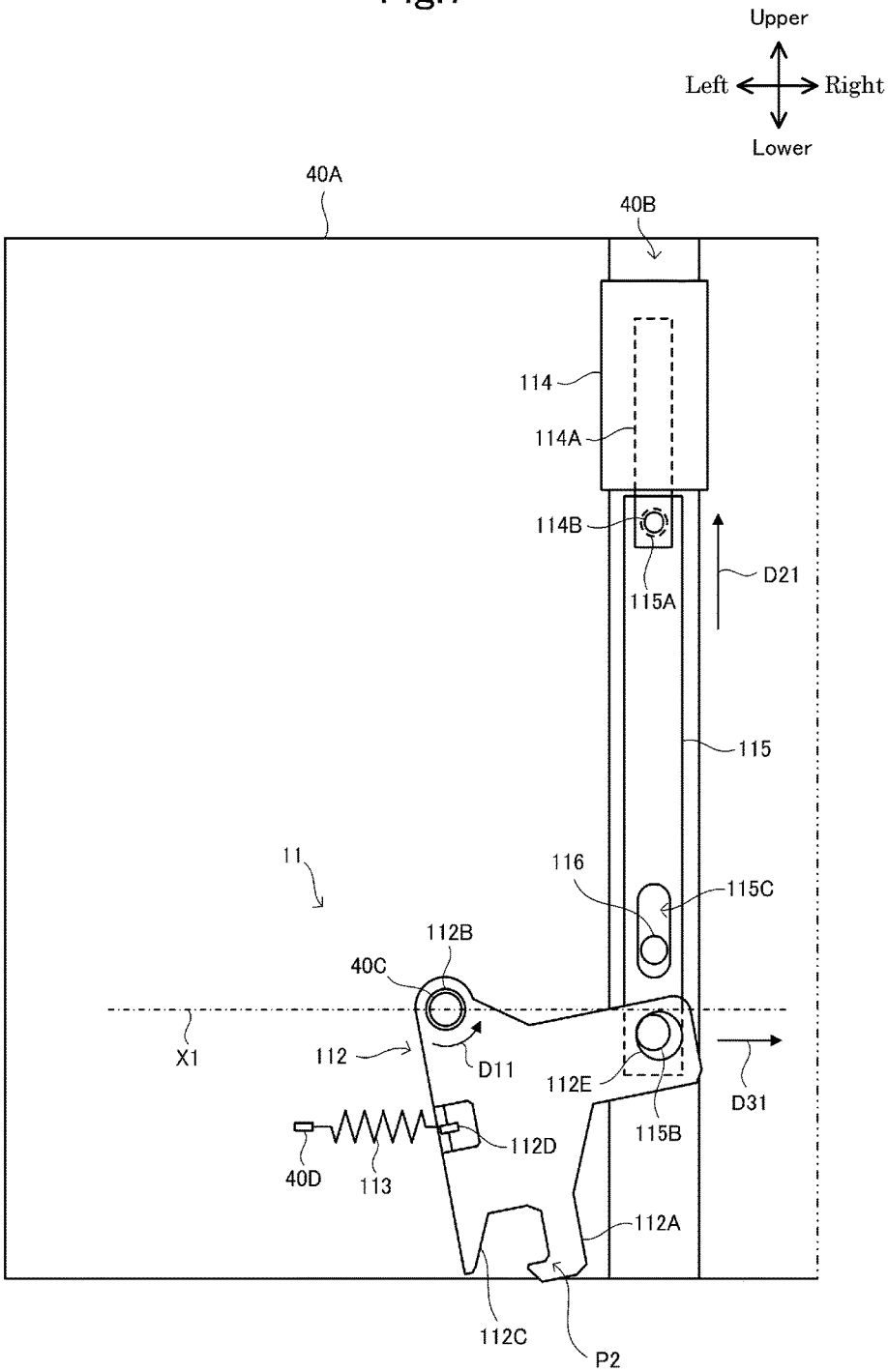
FIG. 7 is a diagram illustrating a configuration of a cover locking device of a multifunctional peripheral according to an embodiment.

As illustrated in FIG. 6, the solenoid 114 is provided inside the locking cover 111 from the restriction member 112. The solenoid 114 is driven according to electric conduction to move the restriction member 112 to the second position P2. Specifically, the solenoid 114 is configured to be driven in a so-called pull type and has a long plunger 114A along a driving direction D21.

The solenoid 114 drives the plunger 114A in the driving direction D21 in accordance with power from a power source (not illustrated) based on a control instruction of the control unit 9. In this way, the restriction member 112 is moved from the first position P1 to the second position P2 via the link member 115 to be described later, so that the locking of the locking cover 111 is released.

In addition, it is sufficient if the driving timing (the locking release timing) of the solenoid 114 by the control unit 9 is an arbitrary timing set in advance. For example, the control unit 9 drives a solenoid 114 corresponding to a developer accommodating unit 101, in which the remaining amount of the developer is equal to or less than the threshold value, at a timing at which the remaining amount of the developer in the developer accommodating unit 101 is equal to or less than the threshold value and the front cover 10A is opened.

The restriction member 112 is provided with a pressing part 112C that presses the engaged part 111A of the locking cover 111 toward the opening direction of the locking cover 111 when the restriction member 112 is moved from the first position P1 to the second position P2 as illustrated in FIG. 6. When the locking by the restriction member 112 is released, the locking cover 111 is pressed by the pressing part 112C and is shifted from the closed state to the opened state.

When a predetermined time lapses after the driving of the solenoid 114 is started, the supply of the power to the solenoid 114 from the power source is stopped. In this way, the restriction member 112 is moved from the second position P2 to the first position P1 by the urging force of the coil spring 113. In addition, when the supply of the power to the solenoid 114 from the power source is stopped, the plunger 114A is returned to a position before driving by an urging member provided inside the solenoid 114.

Thereafter, when attachment/detachment work of the developer accommodating unit 101 by a user is ended and the opened locking cover 111 is closed by the user, the engaged part 111A of the locking cover 111 and the engaging part 112A of the restriction member 112 are engaged with each other by snap-fit. In this way, the locking cover 111 is locked by the restriction member 112, so that attachment/detachment of the developer accommodating unit 101 with respect to the container accommodating unit 10 is restricted by the locking cover 111.

Meanwhile, in a case where the plunger 114A of the solenoid 114 is directly connected to the restriction member 112, when an impact is applied to the locking cover 111, the locking of the locking cover 111 by the restriction member 112 may be released. For example, when the locking cover 111 is hit by a user, since the restriction member 112 is rotated to the second position P2 side by the impact, locking by the restriction member 112 may be released. In this regard, the urging force of the coil spring 113 is reinforced, so that it is possible to suppress the rotation of the restriction member 112 when an impact is applied to the locking cover 111. However, in this case, it is necessary to reinforce the driving force of the solenoid 114 in accordance with the reinforcement of the urging force of the coil spring 113, resulting in an increase in driving electric power in the solenoid 114 or an increase in the size of the solenoid 114.

In contrast, in the multifunctional peripheral 300 according to the present embodiment, it is possible to avoid the release of locking of the locking cover 111 when an impact is applied to the locking cover 111 without reinforcing the urging force of the coil spring 113 as will be described below.

The link member 115 connects the plunger 114A of the solenoid 114 to the restriction member 112 and transmits driving force generated in the solenoid 114 to the restriction member 112. As illustrated in FIG. 6, the link member 115 is provided in a long shape along the driving direction D21 of the solenoid 114.

The link member 115 has a shaft hole 115A at one end in the longitudinal direction. Into the shaft hole 115A, a shaft 114B provided to the plunger 114A of the solenoid 114 is inserted. In this way, the plunger 114A and the link member 115 are connected to each other. In addition, the shaft hole 115A may be provided to the plunger 114A of the solenoid 114 and the shaft 114B may be provided to the link member 115.

Furthermore, the link member 115 has a shaft 115B (an example of a shaft) at the other end in the longitudinal direction. The shaft 115B is inserted into a shaft hole 112E (an example of a bearing) provided to the restriction member 112. In this way, the link member 115 and the restriction member 112 are connected to each other. In addition, the shaft hole 112E may be provided to the link member 115 and the shaft 115B may be provided to the restriction member 112.

Furthermore, as illustrated in FIG. 6, the link member 115 includes the rotating shaft 40C of the restriction member 112 and is connected to the restriction member 112 in a position different from a position crossing a reference surface X1 perpendicular to the driving direction D21. Specifically, the link member 115 is connected to the restriction member 112 at the locking cover 111 side from the reference surface X1. Therefore, in the multifunctional peripheral 300, when the solenoid 114 is driven and the restriction member 112 is rotated in a rotation direction D11 illustrated in FIG. 7, the shaft hole 112E is displaced in a movement direction D31 (see FIG. 7) side in a direction perpendicular to the driving direction D21.

In the multifunctional peripheral 300, the shaft 115B of the link member 115 is loosely fitted to the shaft hole 112E of the restriction member 112. That is, a gap with a predetermined distance is provided between an outer periphery of the shaft 115B and an inner periphery of the shaft hole 112E. In this way, movement of the shaft 115B in the movement direction D31 with the displacement of the shaft hole 112E is suppressed. For example, in the multifunctional peripheral 300, the gap is set such that the shaft 115B is not moved in the movement direction D31 when the solenoid 114 is driven and the restriction member 112 is rotated from the first position P1 to the second position P2. Therefore, when the solenoid 114 is driven and the restriction member 112 is rotated in the rotation direction D11, the link member 115 is not moved in the movement direction D31 with the displacement of the shaft hole 112E. In addition, the gap may permit the movement of the link member 115 in the movement direction D31 with the driving of the solenoid 114.

On the other hand, in the multifunctional peripheral 300, even when an impact is applied to the locking cover 111, the restriction member 112 is rotated in the rotation direction D11. When an impact is applied to the locking cover 111, the link member 115 is moved in the movement direction D31 by an impact transmitted from the restriction member 112.

Figure 8:
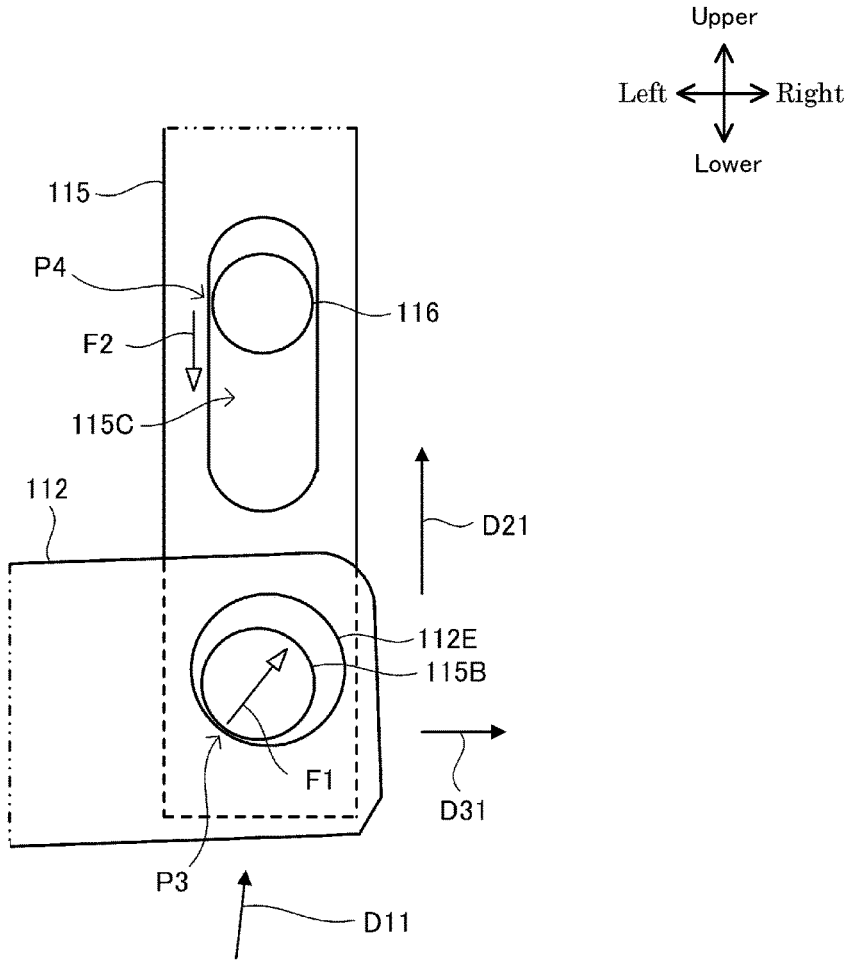
FIG. 8 is a diagram illustrating a partial configuration of a cover locking device of a multifunctional peripheral according to an embodiment.

FIG. 8 illustrates the states of the shaft 115B of the link member 115 and the shaft hole 112E of the restriction member 112 when an impact is applied to the locking cover 111. When an impact is applied to the locking cover 111 and the restriction member 112 is rotated in the rotation direction D11, the shaft 115B of the link member 115 contacts with the shaft hole 112E, which is displaced with the rotation, in a contact position P3. In this way, the link member 115 receives force F1 in a direction vertical to the peripheral surface of the shaft hole 112E in the contact position P3 from the restriction member 112. The force F1 includes component force in the driving direction D21 and component force in the movement direction D31. The link member 115 is moved in the movement direction D31 by the component force in the movement direction D31 included in the force F1. Specifically, the link member 115 is rotated in the movement direction D31 by employing the shaft hole 115A as a fulcrum by the component force in the movement direction D31 included in the force F1. Furthermore, the link member 115 is moved in the driving direction D21 by the component force in the driving direction D21 included in the force F1.

The restraint part 116 restrains the movement of the link member 115 in a direction, which crosses the driving direction D21, in contact with the link member 115.

Specifically, the restraint part 116 is a protruding part provided to protrude in the shaft direction of the rotating shaft 40C of the restriction member 112. On the other hand, the link member 115 is provided with a hole 115C into which the restraint part 116 can be inserted. The hole 115C is formed in a long shape along the driving direction D21 in a position of a connection part side of the link member 115 with the restriction member 112 as illustrated in FIG. 6. The restraint part 116 is provided apart from the inner peripheral surface of the hole 115C in the right and left direction by a predetermined gap in the inside of the hole 115C.

When an impact is applied to the locking cover 111, if the link member 115 is rotated in the movement direction D31 by the component force in the movement direction D31 included in the force F1 received from the restriction member 112, the link member 115 contacts with the restraint part 116 in a contact position P4 as illustrated in FIG. 8. In this way, further movement of the link member 115 in the movement direction D31 is prohibited.

Furthermore, the link member 115 receives the component force in the movement direction D31 included in the force F1 and contacts with the restraint part 116, so that there occurs frictional force F2 against the movement of the link member 115 in the driving direction D21 by the component force in the movement driving direction D21 included in the force F1. In this way, the movement of the link member 115 in the driving direction D21 is restricted and the rotation of the restriction member 112 in the rotation direction D11 is restricted. Therefore, the rotation of the restriction member 112 when an impact is applied to the locking cover 111 is suppressed. Accordingly, it is possible to avoid the release of locking of the locking cover 111 when an impact is applied to the locking cover 111 without reinforcing the urging force of the coil spring 113.

For example, the outer peripheral surface of the restraint part 116 is subjected to roughening processing for increasing a frictional coefficient with the link member 115. In addition, the roughening processing may be performed on the inner peripheral surface of the hole 115C of the link member 115.

In the multifunctional peripheral 300, the restraint part 116 is provided in the inside of the hole 115C. In this way, the installation space of the restraint part 116 is removed to miniaturize the configuration of the cover locking device 11 as compared with the configuration in which the restraint part 116 is provided at a lateral side in the movement direction D31 side of the link member 115. In addition, the restraint part 116 may be a rib provided at a lateral side in the movement direction D31 side of the link member 115. Furthermore, the restraint part 116 may be a wall surface of the concave part 40B of the frame member 40A.

In addition, in the multifunctional peripheral 300, the link member 115 may be connected to the restriction member 112 at the solenoid 114 side from the reference surface X1. Furthermore, in the multifunctional peripheral 300, the shaft 114B of the plunger 114A of the solenoid 114 may be loosely fitted to the shaft hole 115A of the link member 115.

Furthermore, the cover locking device according to the technology of the present disclosure may be applied to a cover member capable of opening and closing an opening in which a member different from the developer accommodating unit 101 is accommodated. For example, the cover locking device according to the technology of the present disclosure may be applied to a cover member capable of opening and closing an opening to/from which an ink accommodating unit for accommodating ink is attached/detached.

What is claimed is:

1. A cover locking device comprising:

a cover member that opens and closes an opening provided at a side of an image forming apparatus;

a restriction member that is rotatable between a first position, in which the restriction member is engaged with the cover member to restrict opening of the cover member when the cover member is in a closed state, and a second position, in which engagement with the cover member is disengaged;

an urging member that urges the restriction member to the first position;

a solenoid including a movable member that is moved in a determined driving direction according to electric conduction to move the restriction member to the second position;

a link member that is connected to the movable member of the solenoid so as to be rotatable, provided in a long shape along the driving direction, and connected to the restriction member in a position different from a position crossing a reference surface which includes a rotating shaft of the restriction member and which is perpendicular to the driving direction, the link member transmitting driving force generated in the solenoid to the restriction member; and a restraint part that restrains movement of the link member in a direction crossing the driving direction in contact with the link member, wherein the link member and the restriction member are connected to each other by a shaft of the link member or the restriction member and a bearing to which the shaft is loosely fitted.

2. The cover locking device of claim 1, wherein the restraint part is a protruding part that protrudes in a shaft direction of the rotating shaft, and the link member has a hole into which the protruding part is inserted.

3. An image forming apparatus comprising:

the cover locking device of claim 1;

a developer accommodating unit that is detachably provided to the opening and accommodates a developer; and an image forming unit that forms an image by using the developer supplied from the developer accommodating unit.

4. The cover locking device of claim 1, wherein the restraint part is provided in a vicinity of a connection part between the restriction member and the link member.

5. The cover locking device of claim 4, wherein the restraint part, a connection part between the movable member of the solenoid and the link member, and the connection part between the restriction member and the link member are positioned on a straight line along the driving direction.

6. The cover locking device of claim 1, wherein the restraint part has a surface subjected to a roughening processing in which there occurs frictional force against movement of the link member toward the solenoid.

7. The cover locking device of claim 6, wherein the restraint part is a protruding part that protrudes in a shaft direction of the rotating shaft, the link member has a hole into which the protruding part is inserted, and the surface subjected to the roughening processing is an outer peripheral surface of the protruding part.

* * * * *